United States Patent [19]

Mariani

[11] 4,455,057

[45] Jun. 19, 1984

[54] INSULATION PIERCING TERMINAL

[75] Inventor: Remo Mariani, Toms River, N.J.

[73] Assignee: Thomas & Betts Corporation, Raritan, N.J.

[21] Appl. No.: 332,715

[22] Filed: Dec. 21, 1981

[51] Int. Cl.[3] ..... H01R 4/18

[52] U.S. Cl. ..... 339/97 C; 174/84 C; 339/97 R

[58] Field of Search ..... 339/97 R, 97 P, 97 C, 339/98, 99; 174/84 C

[56] References Cited

U.S. PATENT DOCUMENTS

| | | | |
|---|---|---|---|
| 2,603,679 | 7/1952 | Pavlinetz | 339/97 C |
| 2,965,699 | 12/1960 | Bollmeier | 174/84 |
| 3,594,704 | 10/1969 | Fischer | 339/97 |
| 3,634,601 | 3/1970 | Pauza | 174/68.5 |
| 3,668,301 | 6/1972 | Faulconer | 174/88 R |
| 3,728,473 | 4/1973 | Kuo | 339/97 C |
| 3,910,672 | 10/1975 | Frantz | 339/97 P |
| 3,914,004 | 10/1975 | Bone | 339/97 |
| 4,054,350 | 10/1977 | Hardesty | 339/99 R |
| 4,070,082 | 1/1978 | Werner | 339/98 |
| 4,312,556 | 1/1982 | Dufau | 339/97 R |

*Primary Examiner*—John McQuade
*Assistant Examiner*—Paula Austin
*Attorney, Agent, or Firm*—Robert M. Rodrick; Salvatore J. Abbruzzese

[57] ABSTRACT

An insulation displacing terminal for mechanically and electrically securing an insulated wire. Contact means provide for electrical connection of an unstripped wire extended through the terminal. The contact means also lock the wire securely to the terminal.

8 Claims, 5 Drawing Figures

INSULATION PIERCING TERMINAL

FIELD OF THE INVENTION

This invention relates to terminals for insulated electrically conductive wire and relates more particularly to insulation piercing and displacing wire terminals.

BACKGROUND OF THE INVENTION

In terminating electrical wire having an outer insulation and an inner electrical conductor, it is necessary to contact the terminal with the electrical conductor. Prior techniques have included stripping away the insulation from the conductor and then attaching the terminal to the stripped end. Aside from the extra step of having to strip the insulation away from the conductor, this technique required the use of a special insulated component insert the wire. Additionally, both a stripping tool and a terminal crimping tool must be used to accomplish the termination. Further, as these connectors hold the wire by means for compressing the connector to the striped conductor, they are susceptible to inadvertent disconnection.

Prior attempts have also been made to provide connectors which pierce the insulation of a conductor cable. Many of these insulation piercing connectors employ spiked projections which are imbeded into the insulation and make electrical contact with the conductor at the point of entry. Mechanical connection is then achieved by compressing the terminal end against the end of the cable to form a "crimp-connection". These connectors are limited to point-to-conductor electrical connection as only the outer extent of the "spike" which comes through the insulation makes contact with the conductor. It is possible for some of the spikes to only knick or abut the conductor preventing complete electrical contact. Thus, electrical connection may be further disrupted by the crimping process which may displace the spike. There exists a need for a superior terminal which displaces insulation and makes sufficient contact with the conductor.

SUMMARY OF THE INVENTION

It is an object of the present invention to provide an insulation piercing connector.

It is a further object to provide an insulation piercing connector which provides a more secure and electrically superior connection without the need to insulate the components.

In the attainment of the foregoing and other objects, this invention looks toward providing a terminal which will readily accept the unstripped end of an insulated wire. The invention further looks to providing insulation piercing means which will electrically contact the conductor and secure the wire to the terminal. A bendable member can be crimped or otherwise urged downwardly to form multiple areas of pierced electrical connection and also mechanically secure the wire to the terminal. As the insulation is pierced only at the areas of contact with the terminal, further insulation of the components is unnecessary.

In the preferred embodiment of the invention, a one piece terminal is provided, having a body portion and an opening for receiving the unstripped wire. A cantilevered member overhangs the body above the inserted wire. The invention also includes an insulation piercing contact member adjacent the outer extent of the cantilevered member, and an insulation piercing receiving aperture in the body portion. Upon crimping, for example, by ordinary pliers, the contact member will come down and pierce the insulation and force a longitudinal segment of the wire through the receiving aperture further piercing the insulation thereby electrically contacting the conductor and locking the wire in place by engaging the underside of the aperture.

Other objects and features of the invention will be evident from the following detailed description of the preferred embodiments and practices included in the invention and from the drawings herewith.

DETAILED DESCRIPTION OF THE PREFERRED EMBODIMENTS

Figure 1:
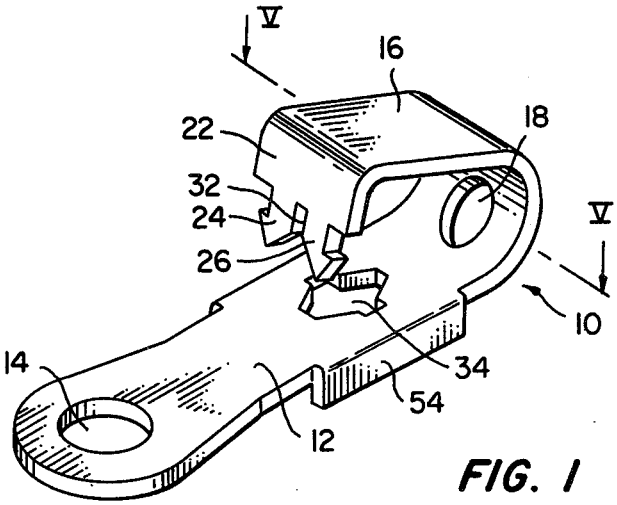
FIG. 1 is a perspective showing of the terminal of the present invention, in open position.
Figure 2:
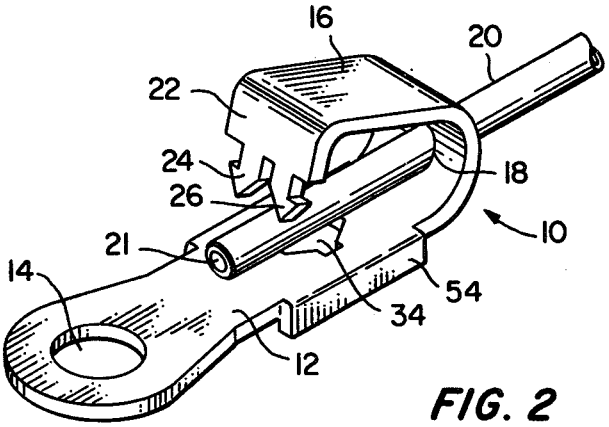
FIG. 2 is a perspective showing of the terminal of FIG. 1 with the wire inserted therein.

Referring to FIGS. 1 and 2, an electrical terminal 10 is shown in open or uncrimped position, respectively with and without wire 20 inserted therein, having a main body 12 which is an elongate flat member having at one end a terminal connection aperture 14. The aperture 14 is shown by way of example, it being contemplated that any connection type member may be employed, such as an insertion pin or the like.

The other end of main body 12 curves upwardly to form cantilevered member 16 which extends over main body 12. The curved portion of cantilevered member 16 includes a passing aperture 18 for receiving wire 20. Passing aperture 18 lies in a plane generally perpendicular to that of main body 12 so that the wire 20 can be inserted to extend longitudinally along the main body 12.

The outer edge 22 of cantilevered member 16 extends downward toward the main body 12 and has depending therefrom a pair of contact members 24 and 26. As shown in detail in FIG. 4, the contact members are preferably arrow-shaped members having insulation piercing edges 28 and 30 for piercing the insulation of wire 20 and contacting the conductor, as will be described hereinafter. Above piercing edges 28 and 30, formed between contact members 24 and 26, is a generally rectangular conductor receiving channel 32.

Contact members 24 and 26 are receivably engaged upon downward flexing of cantilevered member 16, by wire retention aperture 34 centrally located in main body 12. Wire retention aperture shown in further detail in FIG. 5 has a main rectangular channel 35 and includes two pairs of oppositely facing wall surfaces extending from opposite sides of rectangular channel 35. The first set of wall surfaces 36 and 38 lie in intersecting planes, to form a tapered slot 37 for receiving a longitudinal portion of the wire 20. Similarly, the second set of wall surfaces 40 and 42 lie in intersecting planes, forming slot 41 therebetween. Slots 37 and 41 receive a longitudinal extent of wire 20 whereupon wall surfaces 36, 38, 40 and 42 serve as cutting edges to displace the insulation and contact the conductor 21 of wire 20, as will be described hereinafter.

Figure 4:
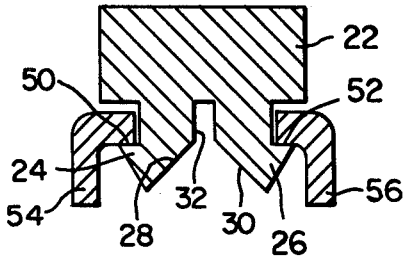
FIG. 4 is a detailed sectional showing of the contact members of the terminal of FIG. 3, shown in engaged position taken along line IV—IV with the wire removed for clarity.

The ends at rectangular channel 35, adjacent slots 37 and 41, form contact receiving chambers 44 and 48. These contact receiving chambers as shown in FIG. 4, accept tabs 50 and 52, which extend laterally from contact members 24 and 26 and measure transversly slightly longer than the transversed measurement of receiving aperture 34. In this manner, cantilevered member 16 is locked down around wire 20 with tabs 50 and 52 engaging the underside of receiving aperture 34. In order to accommodate and protect a longitudinal portion of wire 20 through receiving aperture 34, a pair of support members 54 and 56 depend from the sides of main body 12 adjacent receiving aperture 13, thereby providing clearance for wire 20.

Figure 5:
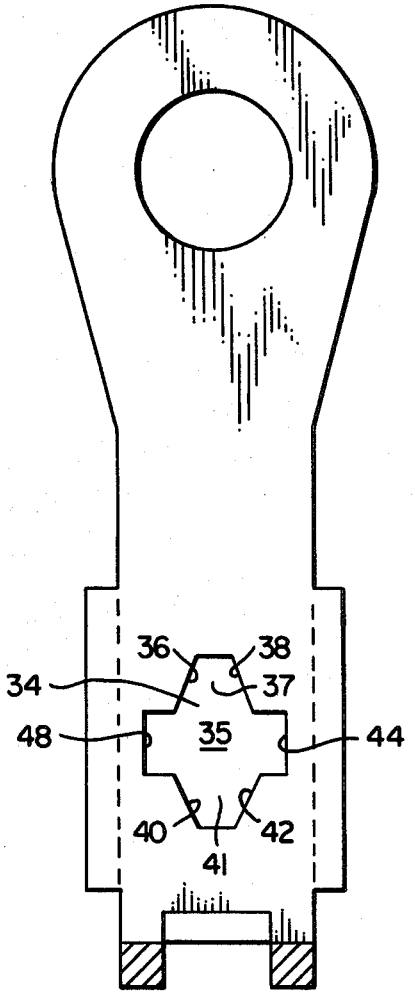
FIG. 5 is a sectional view of the terminal of FIG. 1 as seen along line V—V and showing in detail the central receiving aperture.

The connection of terminal 10 to wire 20 can best be described with reference to FIGS. 2, 3 and 5. Wire 20 is inserted through passing aperture 18 to longitudinally extend along main body 12 across receiving aperture 34. Cantilevered member 16, which overhangs receiving aperture 34, is then crimped down, using an ordinary pair of pliers or similar tool. The downwardly extending edge 22 of cantilevered member 16 and contact members 24 and 26 engage wire 20 to first pierce the insulation, and second, to force a longitudinal section of wire 20 through receiving aperture 34.

Figure 3:
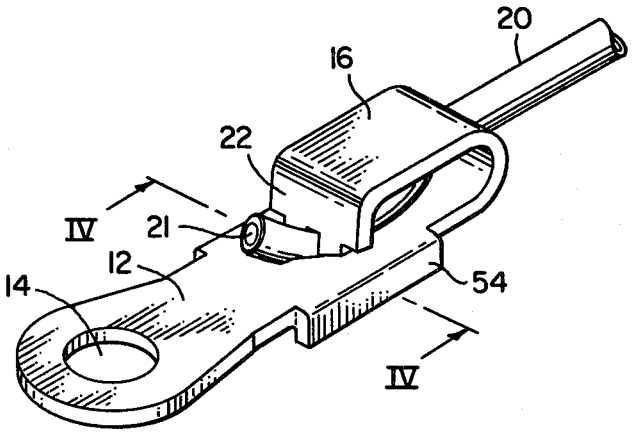
FIG. 3 is the terminal and wire of FIG. 2 shown in crimped/contacted position.

Each pair of wall surfaces 36, 38 and 40 and 42 during such crimping, pierce the insulation of wire 20, which will be forced into the spaced apart tapered ends of aperture 34, as shown in FIG. 3. Oppositely facing wall surfaces 36 and 38, as well as wall surfaces 40 and 42 will contact the conductor 21 of wire 20 along an eliptical line of contact providing good electrical connection.

As the cantilevered member is further crimped down, contact members 24 and 26 will further pierce the insulation of wire 20 and contact conductor 21 by seating it in channel 32 formed between the two downwardly extending contact members. Thus, electrical connection will also be obtained between the channel 32 and conductor 21.

In addition to providing complete electrical connection between the channel 32, conductor 21 and both tapered ends of receiving aperture 34, terminal 10 also mechanically secures wire 20. Tab portions 50 and 52 engage the underside of receiving chambers 44 and 48 to lock down cantilevered member 16, firmly securing wire 20 to terminal 10.

Various changes to the foregoing described and shown structures will now be evident to those skilled in the art. Accordingly, the particularly disclosed preferred embodiments are intended in an illustrative and not in a limiting sense. The scope of the invention is set forth in the following claims.

What is claimed is:

1. A unipartite electrical terminal for piercing, securing and making electrical contact with a wire having a conductor and outer insulation on said conductor comprising:

a body having an opening for receiving said wire and terminal connecting means thereon;

a movable member depending from and projecting over said body;

said movable member being movable into engagement with said body;

first contact means on said body for retentive receipt of said wire and having insulation piercing members for piercing said outer insulation and electrically contacting said conductor upon retentive receipt of said wire; and second contact means on said movable member for engaging said wire and having insulation piercing portions for piercing said outer insulation of said wire and electrically contacting said conductor, said second contact means further including a securement member for locking said second contact means into direct engagement with said first contact means said upon movement of said movable member.

2. A terminal in accordance with claim 1, wherein said first contact means includes an aperture having wall surfaces, the edges of which serve as said insulation piercing members.

3. A terminal in accordance with claim 2, wherein said aperture includes at least one set of opposing wall surfaces that are disposed in intersecting planes.

4. A terminal in accordance with claim 3, wherein said aperture includes a second set of opposing wall surfaces that are disposed in intersecting planes, said first and second sets of opposing wall surfaces being spaced from each other and disposed to receive a longitudinal extent of said wire therein.

5. A terminal in accordance with claim 4, wherein said movable member is a cantilevered member.

6. A terminal in accordance with claim 4 wherein said insulative piercing portions of said second contact means include a pair of spaced-apart projections defining a channel therebetween for insulation-piercing receipt of said wire.

7. A terminal in accordance with claim 6 wherein said securement member includes a locking tab extending from each of said spaced-apart projections.

8. A terminal in accordance with claim 7 wherein said aperture includes a pair of spaced-apart tab receiving chambers between said first and second sets of wall surfaces for retentively securing said locking tabs therein.

* * * * *